US009959877B2

(12) United States Patent
Chebiyyam et al.

(10) Patent No.: US 9,959,877 B2
(45) Date of Patent: May 1, 2018

(54) MULTI CHANNEL CODING

(71) Applicant: QUALCOMM Incorporated, San Diego, CA (US)

(72) Inventors: Venkata Subrahmanyam Chandra Sekhar Chebiyyam, San Diego, CA (US); Venkatraman Atti, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days. days.

(21) Appl. No.: 15/461,312

(22) Filed: Mar. 16, 2017

(65) Prior Publication Data

US 2017/0270936 A1 Sep. 21, 2017

Related U.S. Application Data

(60) Provisional application No. 62/310,635, filed on Mar. 18, 2016.

(51) Int. Cl.

| | |
|---|---|
| ***G10L 19/008*** | (2013.01) |
| ***G10L 19/022*** | (2013.01) |
| ***H04S 3/00*** | (2006.01) |

(52) U.S. Cl.

CPC ..... *G10L 19/008* (2013.01); *G10L 19/022* (2013.01); *H04S 3/008* (2013.01); *H04S 2400/01* (2013.01); *H04S 2400/03* (2013.01); *H04S 2400/05* (2013.01)

(58) Field of Classification Search

None

See application file for complete search history.

(56) References Cited

U.S. PATENT DOCUMENTS

| | | | | |
|---|---|---|---|---|
| 2005/0137729 | A1 | 6/2005 | Sakurai et al. | |
| 2013/0028426 | A1 * | 1/2013 | Purnhagen | G10L 19/008 381/22 |
| 2013/0268264 | A1 | 10/2013 | Taleb et al. | |
| 2016/0035361 | A1 | 2/2016 | Ekstrand et al. | |

FOREIGN PATENT DOCUMENTS

| | | | |
|---|---|---|---|
| EP | 2980791 | A1 | 2/2016 |

OTHER PUBLICATIONS

International Search Report and Written Opinion—PCT/US2017/023035—ISA/EPO—dated May 15, 2017, 13 pages.

* cited by examiner

*Primary Examiner* — Curtis Kuntz
*Assistant Examiner* — Kenny Truong
(74) *Attorney, Agent, or Firm* — Toler Law Group, P.C.

(57) ABSTRACT

A device includes a receiver and a decoder. The receiver is configured to receive stereo parameters encoded, by an encoder, based on a plurality of windows having a first length of overlapping portions between the plurality of windows. The decoder is configured to perform an upmix operation using the stereo parameters to generate at least two audio signals. The at least two audio signals are generated based on a second plurality of windows used in the upmix operation. The second plurality of windows has a second length of overlapping portions between the second plurality of windows. The second length is different from the first length.

32 Claims, 8 Drawing Sheets

MULTI CHANNEL CODING

I. CROSS-REFERENCE TO RELATED APPLICATIONS

The present application claims benefit of U.S. Provisional Patent Application No. 62/310,635, filed Mar. 18, 2016, entitled "MULTI CHANNEL CODING," which is incorporated by reference in its entirety.

II. FIELD

The present disclosure is generally related to audio coding.

III. DESCRIPTION OF RELATED ART

A computing device may include multiple microphones to receive audio signals. In a multichannel encode-decode system, a coder (e.g., an encoder, a decoder, or both) may be configured to function in one or more domains, such as a transform domain, a time domain, a hybrid domain, or another domain, as illustrative, non-limiting examples. In stereo-encoding, audio signals from the microphones may be encoded to generate a mid channel signal and one or more side channel signals. For example, when a stereo (2-channel) signal is coded, a set of spatial parameters can be estimated in one or more bands in a transform domain, such as a discrete Fourier transform (DFT) domain. Additionally or alternatively, another set of spatial parameters may be estimated in the time domain for one or more sub-frames. Other waveform coding may be performed in either the transform domain or the time domain. The mid channel signal may correspond to a sum of the first audio signal and the second audio signal. Additionally, in stereo-decoding, the mid channel signal and one or more side channel signals may be decoded to generate multiple output signals.

In multichannel encode-decode systems, a DFT transformation may be performed on audio signals to convert the audio signals from the time domain to the transform domain. The DFT transformation may be performed on a portion of an audio signal using a window (e.g., an analysis window). The window may include a look ahead portion that introduces some delay to the coding process (e.g., encoding and decoding). Delays introduced based on the look ahead portions of the encoding process and the decoding process contribute to a total amount of delay of the multichannel encode-decode system to encode and decode an audio signal.

IV. SUMMARY

In a particular aspect, a device includes a receiver and a decoder. The receiver is configured to receive stereo parameters encoded, by an encoder, based on a plurality of windows having a first length of overlapping portions between the plurality of windows. The decoder is configured to perform an upmix operation using the stereo parameters to generate at least two audio signals. The at least two audio signals are generated based on a second plurality of windows used in the upmix operation. The second plurality of windows has a second length of overlapping portions between the second plurality of windows. The second length is different from the first length.

In another particular aspect, a method includes receiving stereo parameters encoded, by an encoder, based on a plurality of windows having a first length of overlapping portions between the plurality of windows. The method further includes generating, based on an upmix operation using the stereo parameters, at least two audio signals. The at least two audio signals are generated based on a second plurality of windows used in the upmix operation. The second plurality of windows has a second length of overlapping portions between the second plurality of windows. The second length is different from the first length.

In another particular aspect, an apparatus includes means for receiving stereo parameters encoded, by an encoder, based on a plurality of windows having a first length of overlapping portions between the plurality of windows. The apparatus also includes means for performing an upmix operation using the stereo parameters to generate at least two audio signals. The at least two audio signals are generated based on a second plurality of windows used in the upmix operation. The second plurality of windows has a second length of overlapping portions between the second plurality of windows. The second length is different from the first length.

In another particular aspect, a computer-readable storage device stores instructions that, when executed by a processor, cause the processor to perform operations including receiving stereo parameters encoded, by an encoder, based on a plurality of windows having a first length of overlapping portions between the plurality of windows. The operations also include generating, based on an upmix operation using the stereo parameters, at least two audio signals. The at least two audio signals are generated based on a second plurality of windows used in the upmix operation. The second plurality of windows has a second length of overlapping portions between the second plurality of windows. The second length is different from the first length.

Other aspects, advantages, and features of the present disclosure will become apparent after review of the application, including the following sections: Brief Description of the Drawings, Detailed Description, and the Claims.

V. BRIEF DESCRIPTION OF THE DRAWINGS

FIG. 1 a block diagram of a particular illustrative example of a system that includes an encoder operable to encode multiple audio signals and a decoder operative to decode multiple audio signals;

Figure 1:
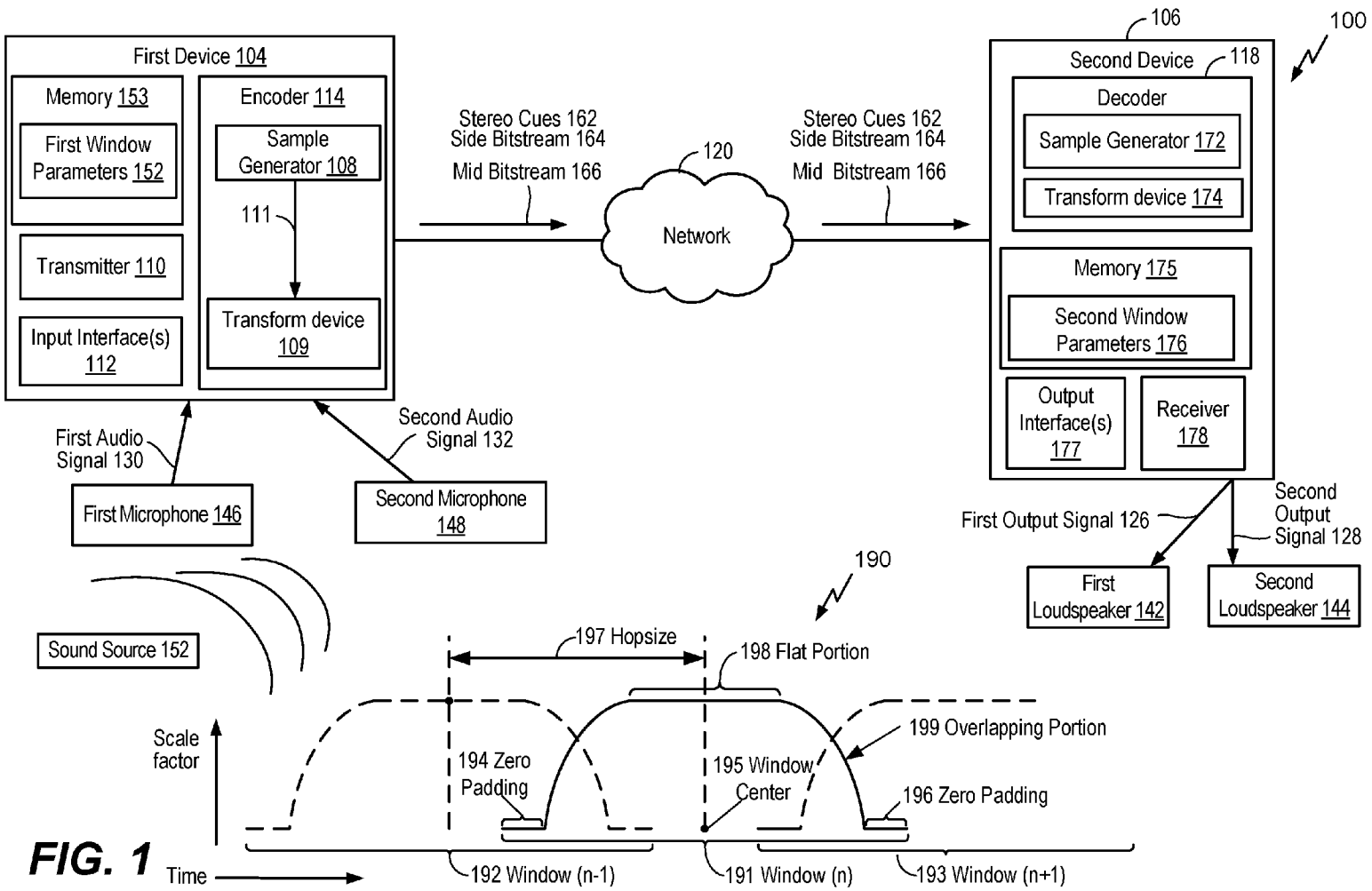
Figure 4:
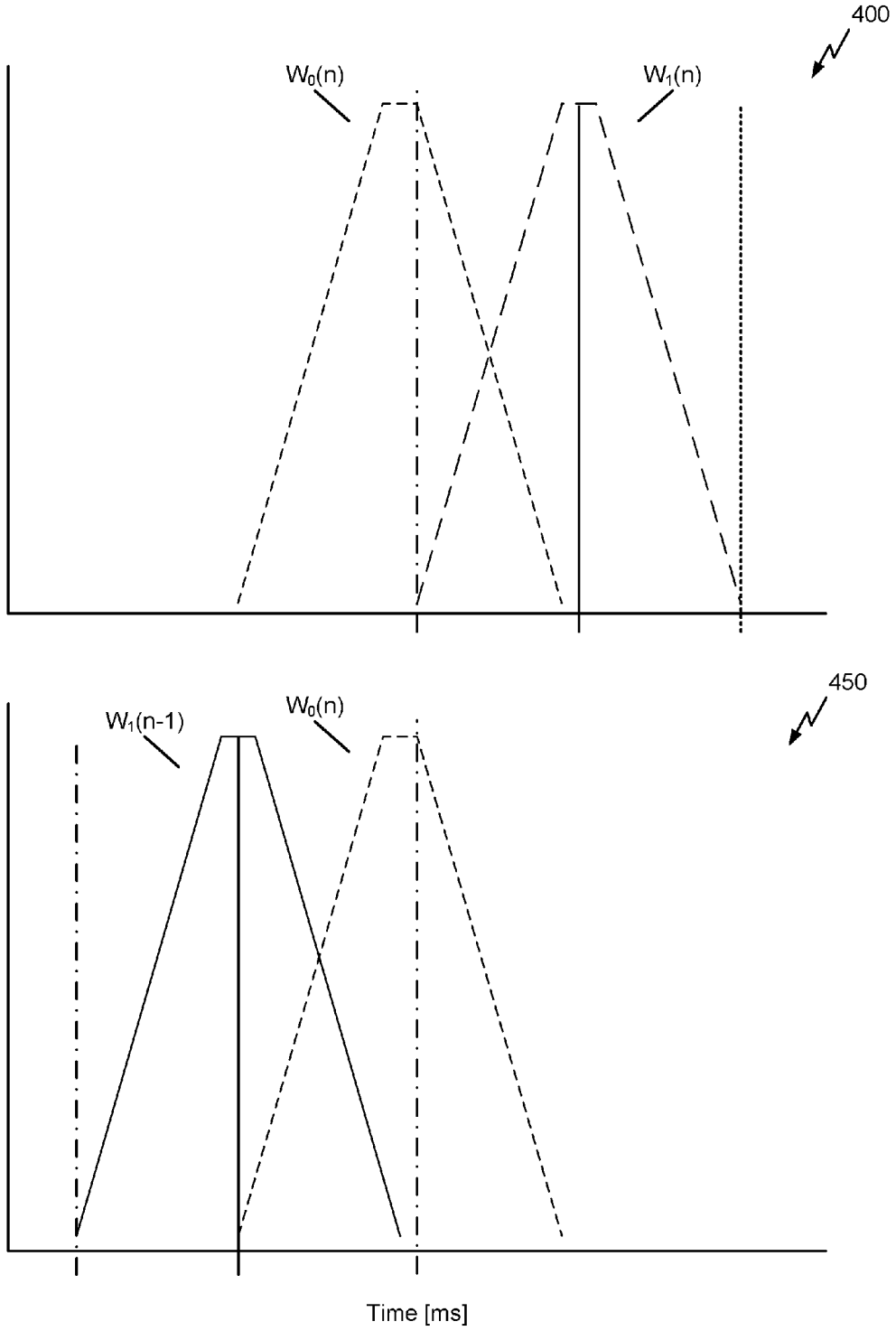
Figure 5:
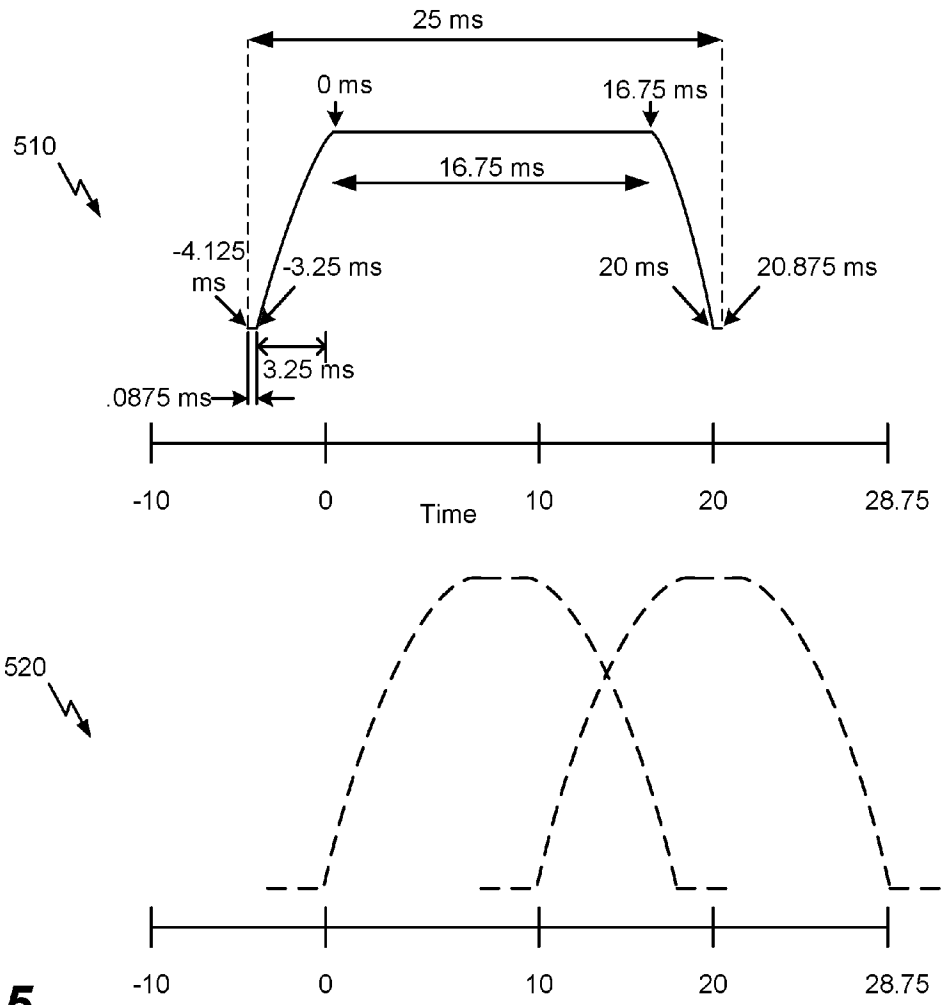
Figure 6:
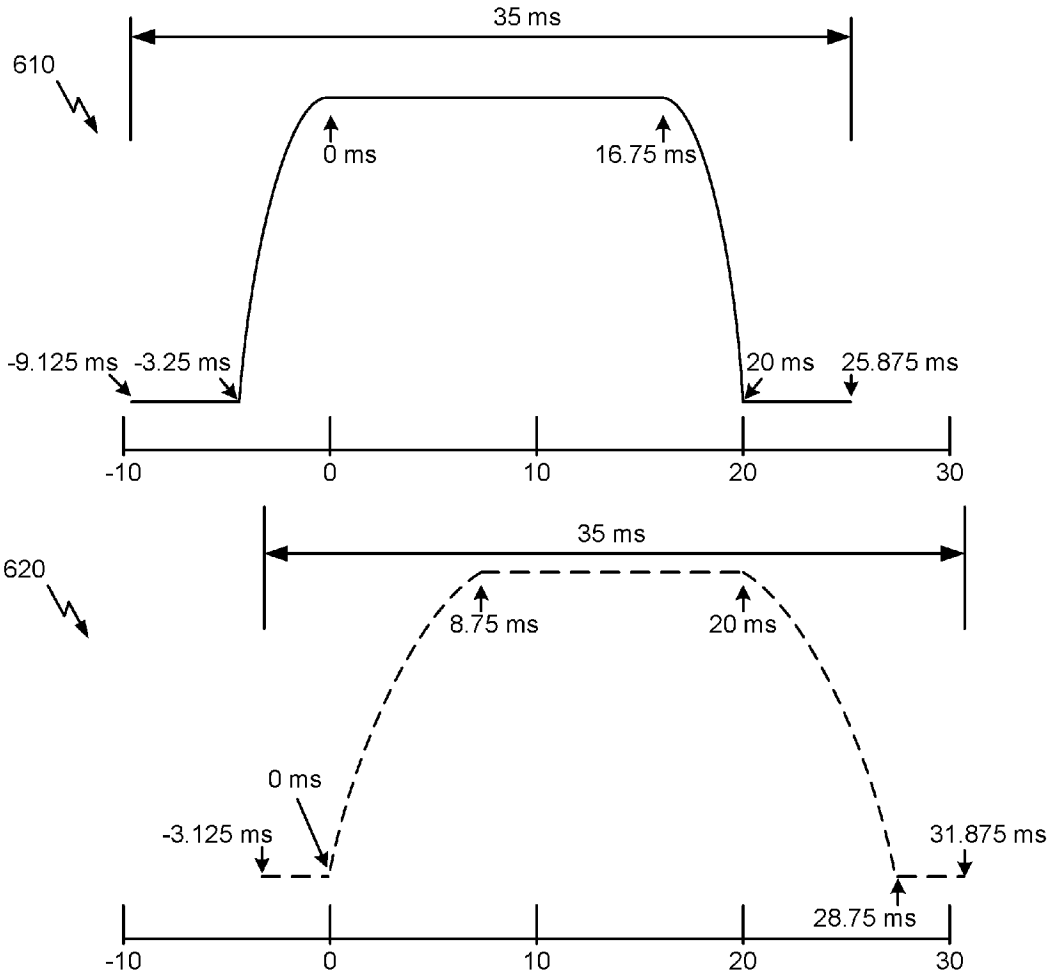
Figure 7:
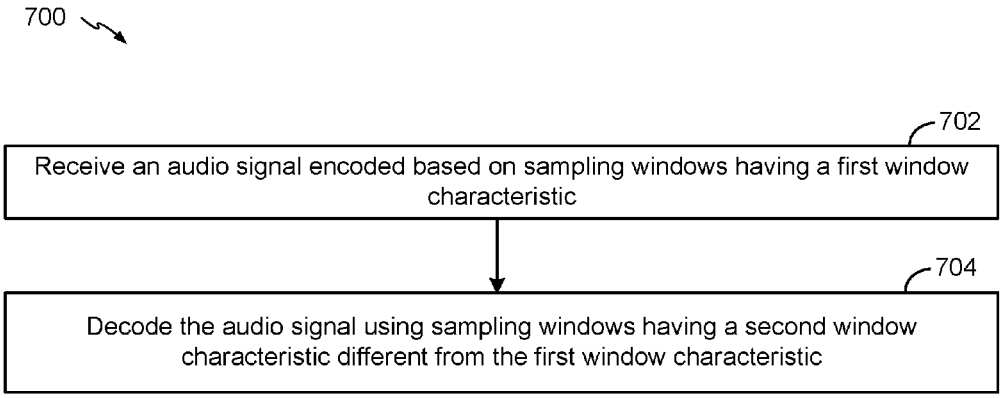
Figure 8:
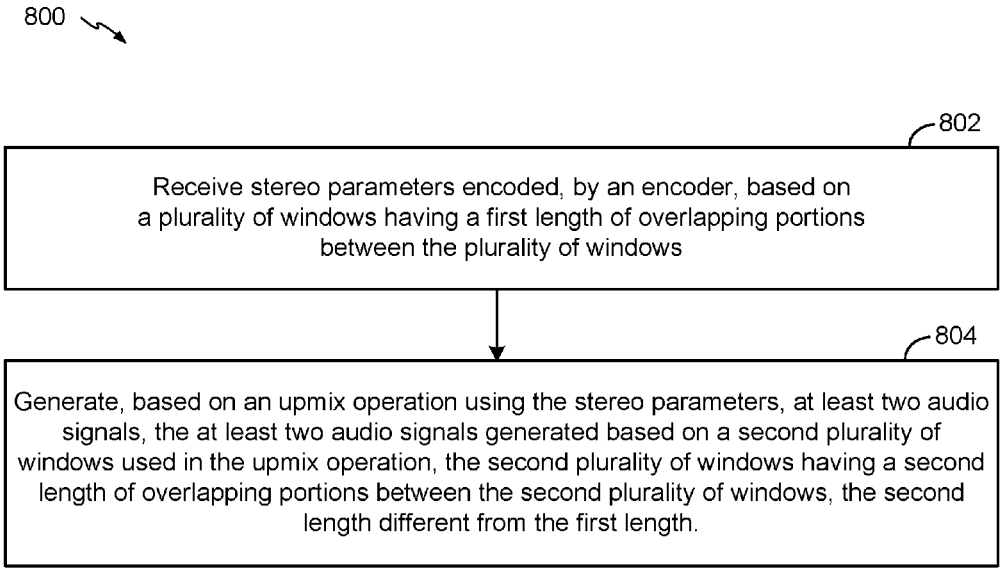
Figure 9:
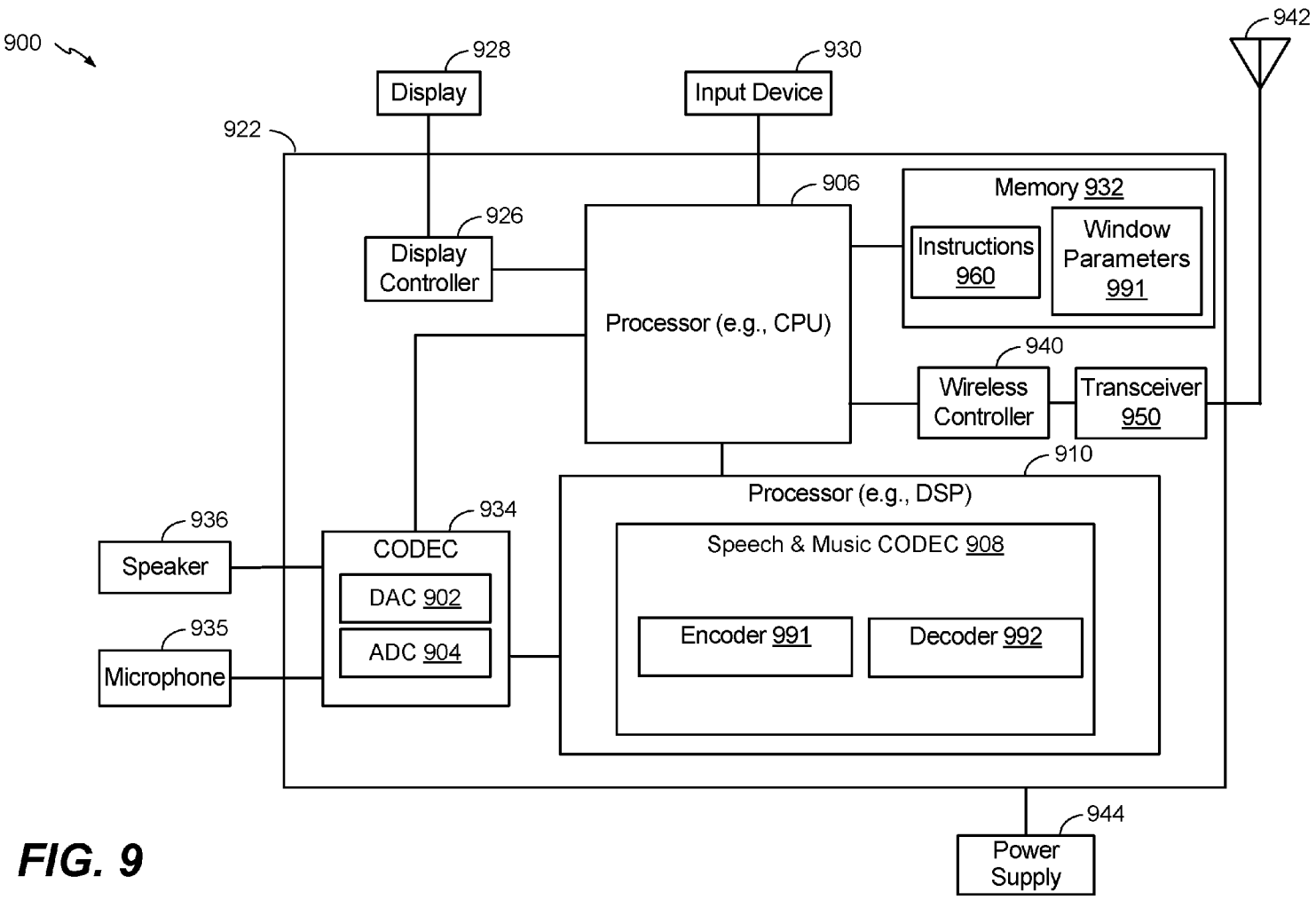

FIG. 4 includes a first illustrative example of windows for encoding and decoding performed by the system of FIG. 1;

FIG. 5 includes a second illustrative example of windows for encoding and decoding performed by the system of FIG. 1;

FIG. 6 includes a third illustrative example of windows for encoding and decoding performed by the system of FIG. 1;

FIG. 7 is a flow chart illustrating an example of a method of operating a coder;

FIG. 8 is a flow chart illustrating an example of a method of operating a coder; and FIG. 9 is a block diagram of a particular illustrative example of a device that is operable to encode multiple audio signals.

VI. DETAILED DESCRIPTION

Particular aspects of the present disclosure are described below with reference to the drawings. In the description, common features are designated by common reference numbers. As used herein, various terminology is used for the purpose of describing particular implementations only and is not intended to be limiting of implementations. For example, the singular forms "a," "an," and "the" are intended to include the plural forms as well, unless the context clearly indicates otherwise. It may be further understood that the terms "comprise", "comprises", and "comprising" may be used interchangeably with "include", "includes", or "including." Additionally, it will be understood that the term "wherein" may be used interchangeably with "where." As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to one or more of a particular element, and the term "plurality" refers to multiple (e.g., two or more) of a particular element.

In the present disclosure, terms such as "determining", "calculating", "shifting", "adjusting", etc. may be used to describe how one or more operations are performed. It should be noted that such terms are not to be construed as limiting and other techniques may be utilized to perform similar operations. Additionally, as referred to herein, "generating", "calculating", "using", "selecting", "accessing", and "determining" may be used interchangeably. For example, "generating", "calculating", or "determining" a parameter (or a signal) may refer to actively generating, calculating, or determining the parameter (or the signal) or may refer to using, selecting, or accessing the parameter (or signal) that is already generated, such as by another component or device.

In the present disclosure, systems and devices operable to code (e.g., encode, decode, or both) multiple audio signals are disclosed. In some implementations, encoder/decoder windowing may be mismatched for multichannel signal coding to reduce decoding delay, as described further herein.

A device may include an encoder configured to encode the multiple audio signals, a decoder configured to decode multiple audio signals, or both. The multiple audio signals may be captured concurrently in time using multiple recording devices, e.g., multiple microphones. In some examples, the multiple audio signals (or multi-channel audio) may be synthetically (e.g., artificially) generated by multiplexing several audio channels that are recorded at the same time or at different times. As illustrative examples, the concurrent recording or multiplexing of the audio channels may result in a 2-channel configuration (i.e., Stereo: Left and Right), a 5.1 channel configuration (Left, Right, Center, Left Surround, Right Surround, and the low frequency emphasis (LFE) channels), a 7.1 channel configuration, a 7.1+4 channel configuration, a 22.2 channel configuration, or a N-channel configuration.

In some systems, an encoder and a decoder may operate as a pair. The encoder may perform one or more operations to encode an audio signal and the decoder may perform the one or more operations (in a reverse order) to generate a decoded audio output. To illustrate, each of the encoder and the decoder may be configured to perform a transform operation (e.g., a DFT operation) and an inverse transform operation (e.g., an IDFT operation). For example, the encoder may transform an audio signal from a time domain to a transform domain to estimate one or more parameters (e.g., Inter Channel stereo parameters) in transform domain bands, such as DFT bands. The encoder may also waveform code one or more audio signals based on the estimated one or more parameters. As another example, the decoder may transform a synthesized audio signal from a time domain to a transform domain prior to application of one or more received parameters to the received audio signal.

Prior to each transform operation and post each inverse transform operation, a signal (e.g., an audio signal) is "windowed" to generate windowed samples and the windowed samples are used to perform the transform operation or the inverse transform operation. In some embodiments, in multichannel coding or stereo coding, the stereo downmix operation is performed in the transform domain and the estimated stereo cue parameters are transmitted along with the side and mid channel coded bitstream. The mid channel and side channel are encoded for example using ACELP/BWE or TCX coding after inverse transforming the stereo downmixed mid and side signals. At the decoder, the mid and side channel are decoded, windowed, transformed to frequency domain followed by stereo upmix processing, inverse transform, and window overlap add to generate the multiple-channels (or stereo channels) for rendering. As used herein, applying a window to a signal or windowing a signal includes scaling a portion of the signal to generate a time-range of samples of the signal. Scaling the portion may include multiplying the portion of the signal by values that correspond to a shape of a window.

In some implementations, the encoder and the decoder may implement different windowing schemes. A particular windowing scheme implemented by the encoder or the decoder may be used for DFT analysis (e.g., to perform a DFT transform) or may be used for DFT synthesis (e.g., to perform an inverse DFT inverse transform). As used herein, a window (or an analysis-synthesis window) is an analysis window, a synthesis window, or both an analysis window and a corresponding synthesis window. As an example of different windowing schemes implemented by the encoder and the decoder, the encoder may apply a first window having a first set of characteristics (e.g., a first set of parameters) and the decoder may apply a second window having a second set of characteristics (e.g., a second set of parameters). One or more characteristics of the first set of characteristics may be different from the second set of characteristics. For example, the first set of characteristics may differ from the second set of characteristics in terms of a size of the window's overlapping portion size (e.g., based on a look ahead amount), an amount of zero padding, a window's hop size, a window's center, a size of a flat portion of the window, a window's shape, or a combination thereof, as illustrative, non-limiting examples. In some implementations, the first window at the encoder (e.g., in multichannel or stereo downmix processing) is configured to generate first windowed samples and the second window at the decoder (e.g., in multichannel or stereo upmix processing) is configured to generate second windowed samples. The first windowed samples and second windowed samples may correspond to different time-frame or different set of samples that is associated with the encoder delay and the decoder delay of the system. The first windowed samples and the second windowed samples may have the same DFT bin resolution or may have different DFT bin resolutions. For example, the first window at the encoder may be 25 ms long resulting in 40 Hz DFT bin (frequency) resolution, and the second window at the decoder may be 20 ms long resulting in 50 Hz DFT bin (frequency) resolution. The window may include the overlap portion, a flat portion and a zero-padding portion.

One particular advantage provided by at least one of the disclosed aspects is that a coding delay may be reduced. Further, the computational complexity of the coder may be significantly reduced. For example, by having the first window and the second window be mismatched (e.g., a zero-padding portion or overlapping portion of the second window at the decoder may be shorter than a zero-padding portion or overlapping portion of the first window at the encoder), a delay may be reduced as compared to a system where both the encoder and the decoder use the same first window (with large overlapping portion and zero-padding portion) and are applied on samples corresponding to the same time-range of samples.

Referring to FIG. 1, a particular illustrative example of a system 100 is depicted. The system 100 includes a first device 104 communicatively coupled, via a network 120, to a second device 106. The network 120 may include one or more wireless networks, one or more wired networks, or a combination thereof.

The first device 104 may include an encoder 114, a transmitter 110, one or more input interfaces 112, or a combination thereof. A first input interface of the input interface(s) 112 may be coupled to a first microphone 146. A second input interface of the input interface(s) 112 may be coupled to a second microphone 148. The encoder 114 may include a sample generator 108 and a transform device 109 and may be configured to encode multiple audio signals, as described herein.

The first device 104 may also include a memory 153 configured to store first window parameters 152. The first window parameters 152 may define a first window or a first windowing scheme to be applied by the sample generator 108 to at least a portion of an audio signal, such as the first audio signal 130 or the second audio signal 132. For example, the sample generator 108 may apply a first window (based on the first window parameters 152) to at least a portion of an audio signal to generate windowed samples 111 that are provided to the transform device 109. The transform device 109 may be configured to perform a transform operation, such as a transform operation (e.g., a DFT operation) or an inverse transform operation (e.g., an IDFT operation), on the windowed samples.

An example of a windowing scheme 190 includes multiple windows, such as a first window (n−1) 192, a second window (n) 191, and a third window (n+1) 193, where n is an integer. Although the windowing scheme 190 is described as having three windows, in other implementations, the windowing scheme may include more than or fewer than three windows.

Referring to the second window (n) 191, the second window (n) 191 includes zero padding portions 194, 196, a window center 195, and a flat portion 198. The zero padding portions 194, 196 may be included in the second window (n) 191, for example, to control a total length (e.g., a duration) of the second window (n) 191. The flat portion 198 may correspond to, for example, a scaling factor of 1. The second window (n) 191 may also include multiple overlapping portions, such as a representative overlapping portion 199. A hop size 197 may indicate an offset of the second window (n) 191 with respect to the first window (n−1) 192. The hop size between any two consecutive windows of the windowing scheme 190 may be the same.

The second device 106 may include a decoder 118, a memory 175, a receiver 178, one or more output interfaces 177, or a combination thereof. The receiver 178 of the second device 106 may receive an encoded audio signal (e.g., one or more bit streams), one or more parameters, or both from the first device 104 via the network 120. The decoder 118 may include a sample generator 172 and a transform device 174, and may be configured to render the multiple channels. The second device 106 may be coupled to a first loudspeaker 142, a second loudspeaker 144, or both.

The memory 175 may be configured to store second window parameters 176. The second window parameters 176 may define a second window or a second windowing scheme to be applied by the sample generator 172 to at least a portion of an audio signal, such as an encoded audio signal (e.g., the side bitstream 164, the mid bitstream 166, or both). For example, the sample generator 172 may apply a second window (based on the second window parameters 176) to at least a portion of an encoded audio signal to generate windowed samples that are provided to the transform device 174. The transform device 174 may be configured to perform a transform operation, such as a transform operation (e.g., a DFT operation) or an inverse transform operation (e.g., an IDFT operation), on the windowed samples.

The first window parameters 152 (of the first device 104) used by the encoder 114 and the second window parameters 176 (of the second device 106) used by the decoder 118 may be mismatched. For example, the first window (defined by the first window parameters 152) may differ from the second window (defined by the second window parameters 176) in terms of a size of the window's overlapping portion size (e.g., based on a look ahead amount), an amount of zero padding, a window's hop size, a window's center, a size of a flat portion of the window, a window's shape, or a combination thereof, as illustrative, non-limiting examples. In some implementations, the first window at the encoder 114 (e.g., in multichannel or stereo downmix processing) is configured to generate first windowed samples and the second window at the decoder 118 (e.g., in multichannel or stereo upmix processing) is configured to generate second windowed samples. In some implementations, the first window is used by the encoder 114 to generate first windowed samples and the second window is used by the decoder 118 to generate second windowed samples. The first windowed samples and the second windowed samples may have the same DFT bin (or frequency) resolution or may have different DFT bin resolutions.

During operation, the first device 104 may receive a first audio signal 130 via the first input interface from the first microphone 146 and may receive a second audio signal 132 via the second input interface from the second microphone 148. The first audio signal 130 may correspond to one of a right channel signal or a left channel signal. The second audio signal 132 may correspond to the other of the right channel signal or the left channel signal. In some implementations, a sound source 152 (e.g., a user, a speaker, ambient noise, a musical instrument, etc.) may be closer to the first microphone 146 than to the second microphone 148. Accordingly, an audio signal from the sound source 152 may be received at the input interface(s) 112 via the first microphone 146 at an earlier time than via the second microphone 148. This natural delay in the multi-channel signal acquisition through the multiple microphones may introduce a temporal shift between the first audio signal 130 and the second audio signal 132. In some implementations, the encoder 114 may be configured to adjust (e.g., shift) at least one of the first audio signal 130 or the second audio signal 132 to temporally align the first audio signal 130 and the second audio signal 132 in time. For example, the encoder 118 may shift a first frame (of the first audio signal 130) with respect to a second frame (of the second audio signal 132).

The sample generator 108 may apply a first window (based on the first window parameters 152) to at least a portion of an audio signal to generate windowed samples 111 that are provided to the transform device 109. The windowed samples 111 may be generated in a time-domain. The transform device 109 (e.g., a frequency-domain stereo coder) may transform one or more time-domain signals, such as the windowed samples (e.g., the first audio signal 130 and the second audio signal 132), into frequency-domain signals. The frequency-domain signals may be used to estimate stereo cues 162. The stereo cues 162 may include parameters that enable rendering of spatial properties associated with left channels and right channels. According to some implementations, the stereo cues 162 may include parameters such as interchannel intensity difference (IID) parameters (e.g., interchannel level differences (ILDs), interchannel time difference (ITD) parameters, interchannel phase difference (IPD) parameters, interchannel correlation (ICC) parameters, stereo filling parameters, non-causal shift parameters, spectral tilt parameters, inter-channel voicing parameters, inter-channel pitch parameters, inter-channel gain parameters, etc., as illustrative, non-limiting examples). The stereo cues 162 may be used at the frequency domain stereo coder 109 during the stereo downmix processing. The stereo cues 162 may also be transmitted as part of an encoded signal. Estimation and use of the stereo cues 162 is described in greater detail with respect to FIG. 2.

The encoder 114 may also generate a side bitstream 164 and a mid bitstream 166 based at least in part on the frequency-domain signals. For purposes of illustration, unless otherwise noted, it is assumed that that the first audio signal 130 is a left-channel signal (l or L) and the second signal 132 is a right-channel signal (r or R). The frequency-domain representation of the first audio signal 130 may be noted as $L_{fr}(b)$ and the frequency-domain representation of the second audio signal 132 may be noted as $R_{fr}(b)$, where b represents a frequency band of the frequency bin. According to one implementation, a side signal $S_{fr}(b)$ may be generated in the frequency-domain from frequency-domain representations of the first audio signal 130 and the second audio signal 132. For example, the side signal $S_{fr}(b)$ may be expressed as $(L_{fr}(b)-R_{fr}(b))/2$. The side signal $S_{fr}(b)$ may be provided to a "side or residual" encoder to generate the side bitstream 164. According to one implementation, a mid signal $M_{fr}(b)$ may be generated in the frequency-domain from frequency-domain representations of the first audio signal 130 and the second audio signal 132. According to one implementation, a mid signal $M_{fr}(b)$ may be generated in the frequency-domain and transformed into the frequency-domain a mid signal m(t). According to another implementation, a mid signal m(t) may be generated in the time-domain and transformed into the frequency-domain. For example, the mid signal m(t) may be expressed as (l(t)+r(t)/2. Generating the mid signal and the side signal is described in greater detail with respect to FIG. 2. The time-domain/frequency-domain mid signals may be provided to a mid signal encoder to generate the mid bitstream 166.

The side signal $S_{fr}(b)$ and the mid signal m(t) or $M_{fr}(b)$ may be encoded using multiple techniques. According to one implementation, the time-domain mid signal m(t) may be encoded using a time-domain technique, such as algebraic code-excited linear prediction (ACELP), with a bandwidth extension for high-band coding.

One implementation of side coding includes predicting a side signal $S_{PRED}(b)$ from the frequency-domain mid signal $M_{fr}(b)$ using the information in the frequency mid signal $M_{fr}(b)$ and the stereo cues 162 (e.g., ILDs) corresponding to the band (b). For example, the predicted side signal $S_{PRED}(b)$ may be expressed as $M_{fr}(b)*(ILD(b)-1)/(ILD(b)+1)$. An error signal (or a residual signal) e(b) in the band (b) may be calculated as a function of the side signal $S_{fr}(b)$ and the predicted side signal $S_{PRED}(b)$. For example, the error signal e(b) may be expressed as $S_{fr}(b)-S_{PRED}(b)$. The error signal e(b) may be coded using transform-domain coding techniques to generate a coded error signal $e_{CODED}(b)$. For upper-bands, the error signal e(b) may be expressed as a scaled version of a mid signal $M_PAST_{fr}(b)$ in the band (b) from a previous frame. For example, the coded error signal $e_{CODED}(b)$ may be expressed as $g_{PRED}(b)*M_PAST_{fr}(b)$, where, in some implementations, $g_{PRED}(b)$ may be estimated such that an energy of $e(b)-g_{PRED}(b)*M_PAST_{fr}(b)$ is substantially reduced (e.g., minimized). The $g_{PRED}(b)$ values may be alternatively referred to as stereo filling gains.

The transmitter 110 may transmit the stereo cues 162, the side bitstream 164, the mid bitstream 166, or a combination thereof, via the network 120, to the second device 106. Alternatively, or in addition, the transmitter 110 may store the stereo cues 162, the side bitstream 164, the mid bitstream 166, or a combination thereof, at a device of the network 120 or a local device for further processing or decoding later.

The decoder 118 may perform decoding operations based on the stereo cues 162, the side bitstream 164, and the mid bitstream 166. The sample generator 172 may apply a second window (based on the second window parameters 176) to at least a portion of a received encoded (e.g., a synthesized mid signal or side signal) signal (e.g., based on the side bitstream 164, the mid bitstream 166, or both) to generate windowed samples that are provided to the transform device 174. The windowed samples may be generated in a time-domain. The transform device 174 (e.g., a frequency-domain stereo coder) may transform one or more time-domain signals, such as the windowed samples (e.g., the side bitstream 164, the mid bitstream 166, or both), into frequency-domain signals. The stereo cues 162 may be applied to the frequency-domain signals.

By applying the stereo cues 162, the decoder 118 may perform the stereo upmix process and generate a first output signal 126 (e.g., corresponding to first audio signal 130), a second output signal 128 (e.g., corresponding to the second audio signal 132), or both. The second device 106 may output the first output signal 126 via the first loudspeaker 142. The second device 106 may output the second output signal 128 via the second loudspeaker 144. In alternative examples, the first output signal 126 and second output signal 128 may be transmitted as a stereo signal pair to a single output loudspeaker.

Although the first device 104 and the second device 106 have been described as separate devices, in other implementations, the first device 104 may include one or more components described with reference to the second device 106. Additionally or alternatively, the second device 106 may include one or more components described with reference to the first device 104. For example, a single device may include the encoder 114, the decoder 118, the transmitter 110, the receiver 178, the one or more input interfaces 112, the one or more output interfaces 177, and a memory. The memory of the single device may include the first window parameters 152 that define a first window to be applied by the encoder 114 and the second window parameters 176 that define a second window to be applied by the decoder 176.

In a particular implementation, the second device 106 includes the receiver 178 configured to receive stereo parameters (e.g., the stereo cues 162) encoded, by the encoder 114 (of the first device 104), based on a plurality of windows (e.g., a particular windowing scheme) having a first length of overlapping portions between the plurality of windows. The receiver 178 may also be configured to receive a mid signal, such as the mid bitstream 166 generated by the encoder 114 based on a downmix operation using the stereo parameters (e.g., the stereo cues 162) as described with reference to FIG. 2.

Figure 3:
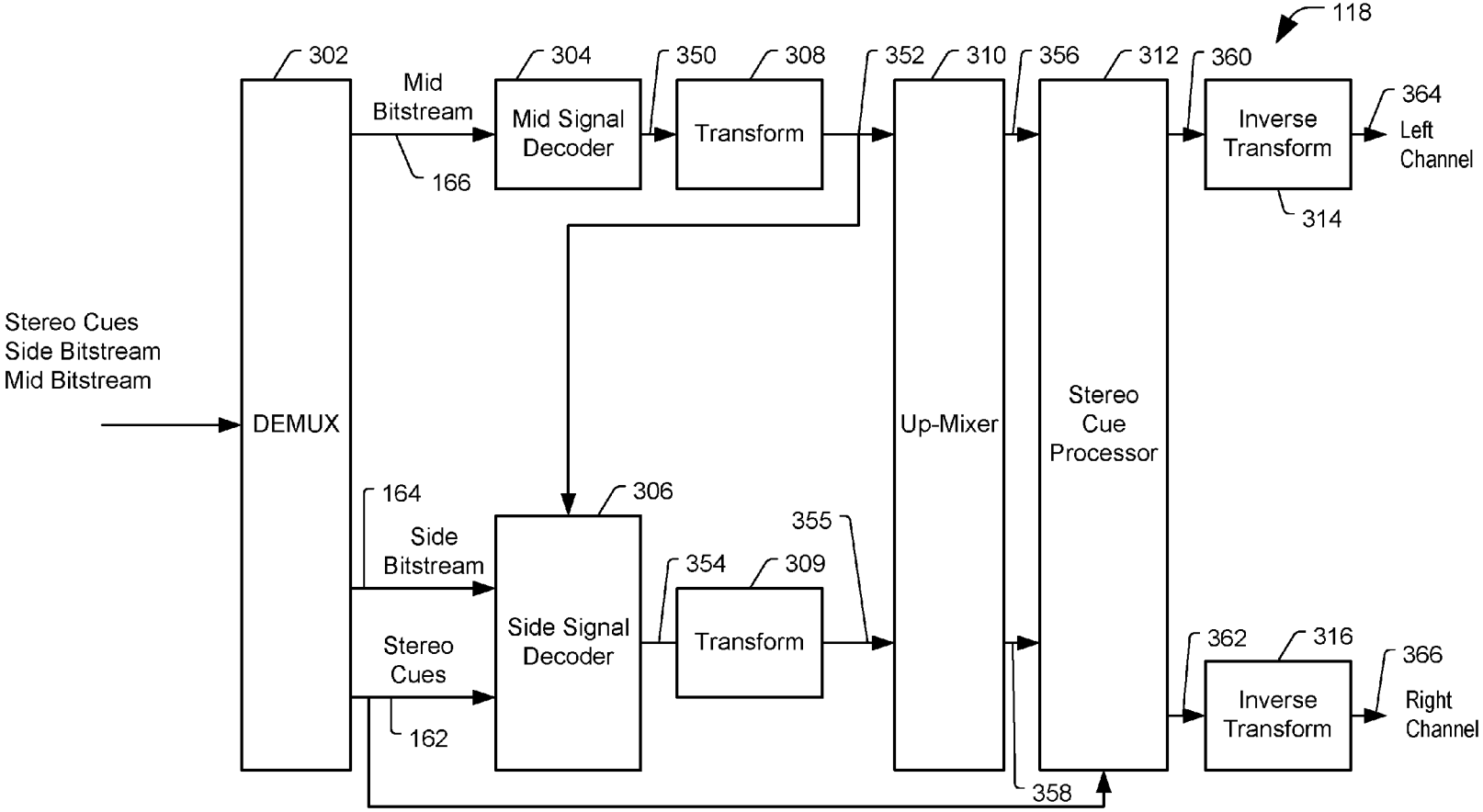
FIG. 3 is a diagram illustrating an example of the decoder of FIG. 1.

The second device 106 further includes the decoder 118 configured to perform an upmix operation, as described further with reference to FIG. 3, using the stereo parameters to generate at least two audio signals, such as the first output signal 126 and the second output signal 128. The second plurality of windows is configured to produce decoding delay that is less than a window overlap corresponding to the plurality of windows. In other words, the inter-frame overlap of the second plurality of windows at the decoder is smaller than the plurality of windows at the corresponding encoder. The at least two audio signals are generated based on a second plurality of windows having a second length of overlapping portions between the second plurality of windows. The second length is different from the first length. For example, the second length is less than the first length. In some implementations, the upmix operation is performed using the stereo parameters and the mid signal. In some implementations, the receiver is configured to receive an audio signal that includes the stereo parameters, and the decoder 118 is configured to apply the second plurality of windows during decoding of the audio signal to generate a windowed time-domain audio decoding signal.

In some implementations, a total length of each window the plurality of windows used by the encoder 114 is different from the total length of each window of the second plurality of windows used by the decoder 118. Additionally or alternatively, a first frequency width associated with each frequency bin in a transform domain at the encoder 114 is different from a second frequency width associated with each frequency bin in the transform domain at the decoder 118.

In some implementations, the plurality of windows is associated with a first hop length and the second plurality of windows is associated with a second hop length. The first hop length is different from the second hop length. Additionally or alternatively, the plurality of windows may include a different number of windows than the second plurality of windows per each frame of audio data. In some implementations, a first window of the plurality of windows and a second window of the second plurality of windows are the same size. In a particular implementation, each window of the plurality of windows is symmetric and a first particular window of the second plurality of windows is asymmetric (e.g., individually or with respect to a second particular window of the second plurality of windows).

In some implementations, a window overlap of the second plurality of windows is asymmetric. Additionally or alternatively, a first window of a pair of consecutive windows of the second plurality of windows is asymmetric. A third length of a first overlap portion of the first window and the second window is different from a fourth length of a second overlap portion of the second window and a third window of a second pair of consecutive windows. In other implementations, both windows of a pair of consecutive windows of the second plurality of windows are symmetric.

In some implementations, the second device 106 includes an encoder that is configured to apply the plurality of windows during encoding of a second audio signal to generate a windowed time-domain audio encoding signal. The second device 106 may further includes a transmitter configured to transmit an output bit stream (e.g., an output audio signal) generated based on the windowed time-domain audio encoding signal.

The system 100 may thus enable reduced coding delay. For example, by having the first window (applied by the encoder 114) and the second window (applied by the decoder 118) be mismatched (e.g., an overlapping portion of the second window of a decoder may be shorter than an overlapping portion of the first window of an encoder), a delay may be reduced as compared to a system where the encoder and the decoder transform windows match exactly and are applied on samples corresponding to the same time-range of samples.

Figure 2:
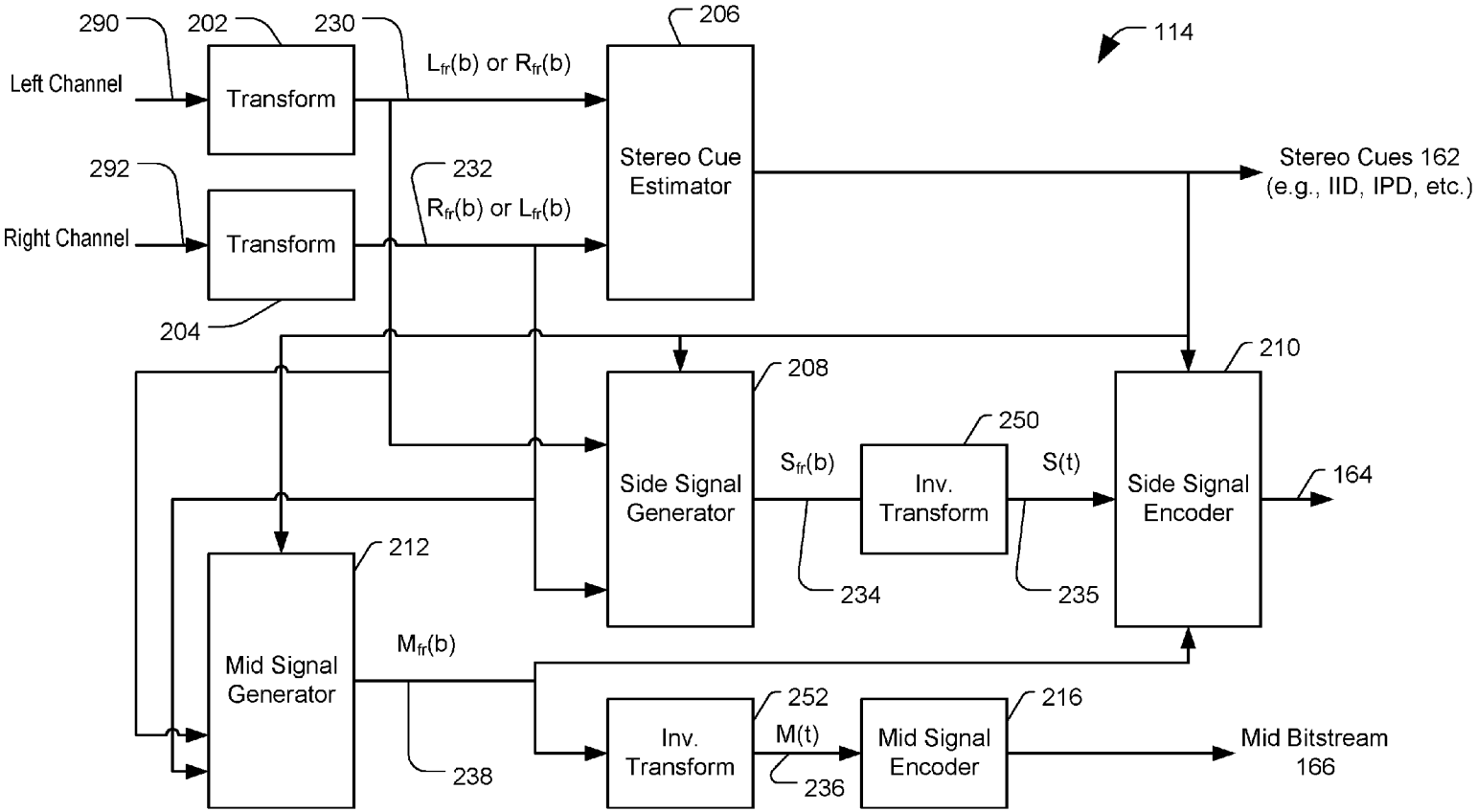
FIG. 2 is a diagram illustrating an example of the encoder of FIG. 1.

Referring to FIG. 2, a diagram illustrating a particular implementation of the encoder 114 is shown. A first signal 290 and a second signal 292 may correspond to a left-channel signal and a right-channel signal. In some implementations, one of the left-channel signal or the right-channel signal (the "target" signal) has been time-shifted relative to the other of the left-channel signal or the right-channel signal (the "reference" signal) to increase coding efficiency (e.g., to reduce side signal energy). In some examples, a first signal or the reference signal 290 may include a windowed left-channel signal, and a second signal or the target signal 292 may include a windowed right-channel signal. The window may be based on the first window parameters 152. However, it should be understood that in other examples, the reference signal 290 may include a windowed right-channel signal and the target signal 292 may include a windowed left-channel signal. In other implementations, the reference channel 290 may be either of the left or the right windowed channel which is chosen on a frame-by-frame basis and similarly, the target signal 292 may be the other of the left or right windowed channels. For the purposes of the descriptions below, an example is provided of the specific case when the reference signal 290 includes a windowed left-channel signal (L) and the target signal 292 includes a windowed right-channel signal (R). Similar descriptions for the other cases can be trivially extended. It is also to be understood that the various components illustrated in FIG. 2 (e.g., transforms, signal generators, encoders, estimators, etc.) may be implemented using hardware (e.g., dedicated circuitry), software (e.g., instructions executed by a processor), or a combination thereof.

A transform 202 may be performed on the reference signal 290 (or the left channel) and a transform 204 may be performed on the target signal 292 (or the right channel). The transforms 202, 204 may be performed by transform operations that generate frequency-domain (or sub-band domain or filtered low-band core and high-band bandwidth extension) signals. As non-limiting examples, performing the transforms 202, 204 may performing include Discrete Fourier Transform (DFT) operations, Fast Fourier Transform (FFT) operations, modified discrete cosine transform (MDCT), etc. on the windowed left channel 290 and the windowed right channel 292. In some other implementations, the windowing based on the first window parameters 152 may be part of the transform device 109 and may be part of the transform 202, 204. According to some implementations, Quadrature Mirror Filterbank (QMF) operations (using filterbands, such as a Complex Low Delay Filter Bank) may be used to split the input signals (e.g., the reference signal 290 and the target signal 292) into multiple sub-bands, and the sub-bands may be converted into the frequency-domain using another frequency-domain transform operation. The transform 202 may be applied to the reference signal 290 to generate a frequency-domain reference signal ($L_{fr}(b)$) 230, and the transform 204 may be applied to the target signal 292 to generate a frequency-domain target signal ($R_{fr}(b)$) 232. The transform 202, 204 operation may include windowing operation based on the first window parameters 152. The frequency-domain reference signal 230 and the frequency-domain target signal 232 may be provided to a stereo cue estimator 206 and to a side signal generator 208.

The stereo cue estimator 206 may extract (e.g., generate) the stereo cues 162 based on the frequency-domain reference signal 230 and the frequency-domain target signal 232. To illustrate, IID(b) may be a function of the energies $E_L(b)$ of the left channels in the band (b) and the energies $E_R(b)$ of the right channels in the band (b). For example, IID(b) may be expressed as $20*\log_{10}(E_L(b)/E_R(b))$. IPDs estimated and transmitted at an encoder may provide an estimate of the phase difference in the frequency-domain between the left and right channels in the band (b). The stereo cues 162 may include additional (or alternative) parameters, such as ICCs, ITDs etc. The stereo cues 162 may be transmitted to the second device 106 of FIG. 1, provided to the side signal generator 208, and provided to a side signal encoder 210. In some implementations, at least one parameter of the stereo parameters is interpolated inter-frame, and the at least one interpolated parameter or at least one un-interpolated value (of the stereo parameters) are sent to and used by the decoder, such as the decoder 118 of FIG. 1. For example, the interpolation can be performed at the encoder and the at least one interpolated parameter can be sent to the decoder. Alternatively, the stereo parameters are sent from the encoder to the decoder and the decoder performs the inter-frame interpolation to generate the at least one interpolated parameter.

The side signal generator 208 may generate a frequency-domain side signal ($S_{fr}(b)$) 234 based on the frequency-domain reference signal 230 and the frequency-domain target signal 232. The frequency-domain side signal 234 may be estimated in the frequency-domain bins/bands. In each band, the gain parameter (g) may be different and may be based on the interchannel level differences (e.g., based on the stereo cues 162). For example, the frequency-domain side signal 234 may be expressed as $(L_{fr}(b)-c(b)*R_{fr}(b))/(1+c(b))$, where c(b) may be the ILD(b) or a function of the ILD(b) (e.g., c(b)=10^(ILD(b)/20)). The frequency-domain side signal 234 may be provided to an inverse transform 250. For example, the frequency-domain side signal 234 may be inverse-transformed back to time domain to generate a time-domain side signal S(t) 235, or transformed to MDCT domain, for coding. The time-domain side signal 235 may be provided to the side signal encoder 210.

The frequency-domain reference signal 230 and the frequency-domain target signal 232 may be provided to a mid signal generator 212. According to some implementations, the stereo cues 162 may also be provided to the mid signal generator 212. The mid signal generator 212 may generate a frequency-domain mid signal $M_{fr}(b)$ 238 based on the frequency-domain reference signal 230 and the frequency-domain target signal 232. According to some implementations, the frequency-domain mid signal $M_{fr}(b)$ 238 may be generated also based on the stereo cues 162. Some methods of generation of the mid signal 238 based on the frequency domain reference channel 230, the target channel 232 and the stereo cues 162 are as follows.

$$M_{fr}(b)=(L_{fr}(b)+R_{fr}(b))/2$$

$M_{fr}(b)=c_1(b)*L_{fr}(b)+c_2*R_{fr}(b)$, where $c_1(b)$ and $c_2(b)$ are complex values.

In some implementations, the complex values $c_1(b)$ and $c_2(b)$ are based on the stereo cues 162. For example, in one implementation of mid side downmix when IPDs are estimated, $c_1(b)=(\cos(-\gamma)-i*\sin(-\gamma))/2^{0.5}$ and $c_2(b)=(\cos(IPD(b)-\gamma)+i*\sin(IPD(b)-\gamma))/2^{0.5}$ where i is the imaginary number signifying the square root of −1.

The frequency-domain mid signal 238 may be provided to an inverse transform 252. For example, the frequency-domain mid signal 238 may be inverse-transformed to time domain to generate a time-domain mid signal 236, or transformed to MDCT domain, for coding. After the inverse transform 252, the mid signal may be windowed and overlap added with the previous frame's windowed mid signal overlapping portion. This window may be similar to or different than the window used in transform 202, 204. The time-domain mid signal 236 may be provided to a mid signal encoder 216, and the frequency-domain mid signal 238 may be provided to the side signal encoder 210 for the purpose of efficient side band signal encoding.

The side signal encoder 210 may generate the side bitstream 164 based on the stereo cues 162, the time-domain side signal 235, and the frequency-domain mid signal 238. The mid signal encoder 216 may generate the mid bitstream 166 based on the time-domain mid signal 236. For example, the mid signal encoder 216 may encode the time-domain mid signal 236 to generate the mid bitstream 166.

The transforms 202 and 204 may be configured to apply an analysis windowing scheme associated with the first window parameters 152 of FIG. 1. For example, the stereo cue parameters 162 may include parameter values computed based on the windowed samples 111 of FIG. 1. Additionally, the inverse transforms 250, 252 may be configured to perform inverse transforms followed by synthesis windowing (generated using a windowing scheme associate with the first window parameters 152 of FIG. 1) to return frequency-domain signals to overlapping windowed time-domain signals.

In some implementations, one or more of the stereo cue estimator 206, the side signal generator 208, and the mid signal generator 212 may be included in a downmixer. Additionally or alternatively, although the encoder 114 is described as including the side signal encoder 210, in other implementations the encoder 114 may not include the side signal encoder 210.

Referring to FIG. 3, a diagram illustrating a particular implementation of the decoder 118 is shown. An encoded audio signal is provided to a demultiplexer (DEMUX) 302 of the decoder 118. The encoded audio signal may include the stereo cues 162, the side bitstream 164, and the mid bitstream 166. The demultiplexer 302 may be configured to extract the mid bitstream 166 from the encoded audio signal and provide the mid bitstream 166 to a mid signal decoder 304. The demultiplexer 302 may also be configured to extract the side bitstream 164 and the stereo cues 162 from the encoded audio signal. The side bitstream 164 and the stereo cues 162 may be provided to a side signal decoder 306.

The mid signal decoder 304 may be configured to decode the mid bitstream 166 to generate a mid signal ($m_{CODED}(t)$) 350. A transform 308 may be applied to the mid signal 350 to generate a frequency-domain mid signal ($M_{CODED}(b)$) 352. The frequency-domain mid signal 352 may be provided to an up-mixer 310.

The side signal decoder 306 may generate a side signal ($S_{CODED}(b)$) 354 based on the side bitstream 164, the stereo cues 162, and the frequency-domain mid signal 352. For example, the error (e) may be decoded for the low-bands and the high-bands. The side signal 354 may be expressed as $S_{PRED}(b)+e_{CODED}(b)$, where $S_{PRED}(b)=M_{CODED}(b)*(ILD(b)-1)/(ILD(b)+1)$. A transform 309 may be applied to the side signal 354 to generate a frequency-domain side signal ($S_{CODED}(b)$) 355. The frequency-domain side signal 355 may also be provided to the up-mixer 310.

The up-mixer 310 may perform an up-mix operation based on the frequency-domain mid signal 352 and the frequency-domain side signal 355. For example, the up-mixer 310 may generate a first up-mixed signal ($L_{fr}$) 356 and a second up-mixed signal ($R_{fr}$) 358 based on the frequency-domain mid signal 352 and frequency-domain the side signal 355. Thus, in the described example, the first up-mixed signal 356 may be a left-channel signal, and the second up-mixed signal 358 may be a right-channel signal. The first up-mixed signal 356 may be expressed as $M_{CODED}(b)+S_{CODED}(b)$, and the second up-mixed signal 358 may be expressed as $M_{CODED}(b)-S_{CODED}(b)$. The up-mixed signals 356, 358 may be provided to a stereo cue processor 312.

The stereo cue processor 312 may apply the stereo cues 162 to the up-mixed signals 356, 358 to generate signals 360, 362. For example, the stereo cues 162 may be applied to the up-mixed left and right channels in the frequency-domain. When available, the IPD (phase differences) may be spread on the left and right channels to maintain the inter-channel phase differences. An inverse transform 314 may be applied to the signal 360 to generate a first time-domain signal l(t) 364 (e.g., a left channel signal), and an inverse transform 316 may be applied to the signal 362 to generate a second time-domain signal r(t) 366 (e.g., a right channel signal). Non-limiting examples of the inverse transforms 314, 316 include Inverse Discrete Cosine Transform (IDCT) operations, Inverse Fast Fourier Transform (IFFT) operations, etc. According to one implementation, the first time-domain signal 364 may be a reconstructed version of the reference signal 290, and the second time-domain signal 366 may be a reconstructed version of the target signal 292.

According to one implementation, the operations performed at the up-mixer 310 may be performed at the stereo cue processor 312. According to another implementation, the operations performed at the stereo cue processor 312 may be performed at the up-mixer 310. According to yet another implementation, the up-mixer 310 and the stereo cue processor 312 may be implemented within a single processing element (e.g., a single processor).

The transforms 308 and 309 may be configured to apply an analysis windowing scheme associated with the second window parameters 176 of FIG. 1. The second windowing parameters 176 associated with the windowing scheme used by the transforms 308 and 309 may be different from a windowing scheme used by an encoder, such as the encoder 114 of FIG. 1. The second windowing scheme may be used at the transforms 308, 309 to reduce delay in decoding. For example, a second windowing scheme (applied by the decoder) may include windows having a different size as the windows used in a first windowing scheme (applied by an encoder) such that the transform may result in same number of frequency bands (but different frequency resolution), and further the amount of window overlap may be reduced for the transforms 308 and 309. Reducing the amount of window overlap reduces a decoding delay of processing overlapped samples from a prior window. Because the stereo cues may be generated based on the first windowing (applied by the encoder 114), the decoder 118 may generate adjusted stereo parameters to account for differences in the windowing schemes. For example, the decoder 114 (e.g., the stereo cue processor 312) may generate adjusted stereo parameters via interpolation (e.g., weighted sums) of the received stereo parameters. Similarly, the inverse transforms 314, 316 may be configured to perform inverse transforms to return frequency-domain signals to overlapping windowed time-domain signals.

In some implementations, the stereo cue processor 312 may be included in the up-mixer 310. Additionally, or alternatively, although the decoder 118 is described as including the side signal decoder 306 and the transform 309, in other implementations the decoder 118 may not include the side signal decoder 306 and the transform 309. In such implementations, the side bitstream 164 may be provided from the demultiplexer 302 to the up-mixer 310 and the stereo cues 162 may be provided from the demultiplexer 302 to the up-mixer 310 or to the stereo cue processor 312.

It is noted that the encoder of FIG. 2 and the decoder of FIG. 3 may include a portion, but not all, of an encoder or decoder framework. For example, the encoder of FIG. 2, the decoder of FIG. 3, or both, may also include a parallel path of high-band (HB) processing. Additionally or alternatively, in some implementations, a time domain downmix may be performed at the encoder of FIG. 2. Additionally or alternatively, a time domain upmix may follow the decoder of FIG. 3 to obtain decoder shift compensated Left and Right channels.

Referring to FIG. 4, an example of windowing schemes implemented at an encoder and decoder is depicted. For example, a windowing scheme implemented by a decoder, such as the decoder 118 of FIG. 1, is depicted and generally designated 400. In some implementations, the windowing scheme 400 may be implemented based on the second window parameters 176. A windowing scheme implemented by an encoder, such as the encoder 114 of FIG. 1, is depicted and generally designated 450. In some implementations, the windowing scheme 450 may be implemented based on the first window parameters 152. With reference to the windowing scheme 400 and the windowing scheme 450, each window is the same. To illustrate, each window has the same zero padding length, the same hop size, the same overlap, and the same flat portion size. For example, the zero padding length is 3.125 ms, the window hop size is 10 ms, the window's overlap length is 8.75 ms, and the size of the flat portion of the window is 1.25 ms. Accordingly, each window may have a total length of 25 ms.

A frame size of an audio signal may be 20 ms and transform operations, such as DFT operations, may be estimated in 2 windows per frame. For each frame, a set of stereo cue parameters (e.g., DFT stereo cue parameters), such as the stereo cues 162 of FIG. 1, may be quantized and transmitted. These stereo cues are also used to generate the mid and the side signals in the transform domain as described with reference to FIGS. 1 and 2 (described above) and as described with reference to Equations 1 and 2 (included below). For example, the Mid channel may be based on:

$$M=(L+g_D R)/2, \text{ or} \qquad \text{Equation 1}$$

$$M=g_1 L+g_2 R \qquad \text{Equation 2}$$

where $g_1+g_2=1.0$, and where $g_D$ is a gain parameter, M corresponds to the Mid channel, L corresponds to the left channel, and R corresponds to the right channel.

Prior to coding, the frame corresponding to [0-28.75] of mid and side is synthesized by applying the inverse transforms on the transform domain mid and side signals. After the inverse transforms, the time domain signals are overlap-added with a similar window as above. In some implementations, the window could be exactly the same; in others, this transform window and the inverse transform window could have different window values in the overlapping regions while keeping the lengths of the zero padding, overlap, and the flat portion size all the same. The overlap-add is used on the inverse transform synthesis because the overlapping windows will produce two sets of time samples in the overlap portion. For example, an inverse transform on $w_0(n)$ (e.g., a first window of frame n) produces the samples from [0-18.75] ms, while an inverse transform produces samples from [10-28.75] ms. The samples from [10-18.75] are overlap added to produce the mid and the side signals for the portion of [0-28.75] ms. Since there is no overlapping window ($w_0(n+1)$) (e.g., a first window of frame n+1) present from the [20-38.75] ms yet on the encoder (as samples after 28.75 are in the future not available in the current frame n), the samples generated from the inverse transform of $w_1(n)$ (e.g., a second window of frame n) are un-windowed and used for coding in the portion of [20-28.75] ms. Unwindowing means that the samples generated from the IDFT are divided by $w_1(n)$ in that portion.

It should be noted that the samples from [20-28.75] on the encoder are part of the mid/side coding look ahead in frame n. On the decoder, these samples may be intended to be decoded in the frame n+1.

On the decoder, we receive the bitstream, first decode the mid and side signals may be received into time domain from the portion [0-20] ms if a speech decoder, such as an ACELP decoder, is used and [0-28.75] ms if a non-speech decoder, such as a TCX decoder, is used. If the non-speech decoder is used, the samples from [20-28.75] may not be used/played out in the current frame, but are stored for overlap add in the next frame which has the effect of producing a usable set of samples from [0-20] ms. Since samples from [20-28.75] are not available at the decoder, a delay of the window hop size is introduced to look back in time and use [−10 to 18.75] ms for windowing and application of the stereo parameters. Once this windowing is performed on the decoded mid/side signals, the upmix is performed followed by stereo parameter application to get the decoded DFT domain representation of the left and the right channels. An inverse DFT is applied followed by an overlap-add operation to obtain the decoded left and right time domain signals.

As depicted in FIG. 4, the encoder windows (of the windowing scheme 450) and the decoder windows (of the windowing scheme 400) have the same characteristics. For example, the encoder windows (of the windowing scheme 450) and the decoder windows (of the windowing scheme 400) have the same sizes, the same amount of overlap, the same zero padding, the same size flat portions, etc. Due to the encoder window and the decoder window match, a delay of 10 ms introduced on the decoder in addition to 28.75 ms delay introduced on the encoder.

It is noted that the windowing scheme 450 of the encoder and the windowing scheme 400 of the decoder are applied at the exact same time samples. For example, as depicted in FIG. 4, the decoder windows and the encoder windows are the same and are situated at the same time range. Thus, the window centers are aligned on the encoder and the decoder. Alternatively, in other implementations, the windows used by the encoder and the windows used by the decoder may not be aligned. For example, a window location (e.g., a window center) of each window of the plurality of windows used by the encoder is different from a window location (e.g., a window center) of each window of the plurality of windows used at the decoder.

Referring to FIG. 5, another example of windowing schemes implemented at an encoder and decoder is depicted. For example, a windowing scheme implemented by a decoder, such as the decoder 118 of FIG. 1, is depicted and generally designated 510. In some implementations, the windowing scheme 510 may be implemented based on the second window parameters 176. A windowing scheme implemented by an encoder, such as the encoder 114 of FIG. 1, is depicted and generally designated 520. In some implementations, the windowing scheme 520 may be implemented based on the first window parameters 152.

The windowing scheme 510 may have a single window per frame (a hop size of 20 ms) and an overlap region of 3.25 ms. Accordingly, the decoder delay is 3.25 ms. The zero padding (zp) length is of the windowing scheme 510 is 0.875 ms on both sides of the window and a length of the flat portion is 16.75 ms. The total length (L) of the window of the windowing scheme 510 may be determined as L=2*zp+2*overlap+flat_portion=25 ms. The length of the overlapping portions+the flat portion together constitute the actual amount of samples used. The zero padding is used to bring the window to a desired size. In another implementation, the windowing scheme 510 may use two windows with an outer overlap of e.g., 3.125 ms while the inner overlap of e.g., 10 ms.

The windowing scheme 520 may include or correspond to the windowing scheme 450 of FIG. 4. It is noted that the total length of each window of the windowing scheme 520 used on the encoder is the same as the total the windowing scheme 510 used on the decoder. By having the same total length, the size of the DFT bins generated by the encoder and the decoder may match. It should be noted that matching the total length of the size of the windows is considered a matter of convenience and, in other implementations, this principle of having the same length, thus having the same size of the DFT bins at the encoder and decoder may be broken. It should be noted that the illustrated windowing scheme 520 may represent windows used for both prior to the DFT Transform operation and post the DFT Inverse Transform operations at the encoder. In some implementations, the windows (e.g., analysis windows, synthesis windows, or both) used at the encoder may be substantially similar to the windowing scheme 520 by having the same overlapping portion length, same zero padding, same flat portion length, same hop size, etc., but the window shape in the overlapping portions may be different (e.g., modified) from the illustrated windowing scheme 520.

Referring to FIG. 6, another example of windowing schemes implemented at an encoder and decoder is depicted. For example, a windowing scheme implemented by a decoder, such as the decoder 118 of FIG. 1, is depicted and generally designated 610. In some implementations, the windowing scheme 610 may be implemented based on the second window parameters 176. A windowing scheme implemented by an encoder, such as the encoder 114 of FIG. 1, is depicted and generally designated 620. In some implementations, the windowing scheme 620 may be implemented based on the first window parameters 152.

The windowing scheme 620 used by the encoder may include one large window as compared to the windowing scheme 450 of FIG. 4 or the windowing scheme 520 of FIG. 5. The windowing scheme 620 may have an overlap region of 8.75 ms, a zero padding length of 3.125 on both sides of the window, and a length of the flat portion is 11.25 ms. The total length (L) of the window of the windowing scheme 620 may be determined as L=2*zp+2*overlap+flat_portion=35 ms.

The windowing scheme 610 used by the decoder may include one window as compared to the windowing scheme 400 of FIG. 4 and may be different from the windowing scheme 510 of FIG. 5. The windowing scheme 610 may have an overlap region of 3.25 ms, a zero padding length of 5.875 ms on both sides of the window, and a length of the flat portion is 16.75 ms. The total length (L) of the window of the windowing scheme 620 may be determined as L=2*zp+2*overlap+flat_portion=35 ms.

In the implementations descried above with reference to FIGS. 5-6, the window centers are not at the same location on the encoder and the decoder. In situations where a specific parameter is very fast varying in time, this mismatch could cause artifacts (e.g., distortions) in an encoded or decoded audio signal. For such fast varying parameters, weighted inter-window interpolation could be performed on the encoder, the decoder, or both. The weighting could be such that the interpolated parameter would be close to the parameter estimated at the decoder window's time range. For example, parameter(b, n) may corresponds to band b in the nth encoder window, where n is an integer. A weighted interpolation: $\alpha_1$*parameter(b, n)+$\alpha_2$*parameter(b, n−1) could be used, where each of $\alpha_1$ and $\alpha_2$ are positive. In some implementations, $\alpha_1+\alpha_2=1$.

Referring to FIG. 7, a flow chart of a particular illustrative example of a method of operating a decoder is disclosed and generally designated 700. The decoder may correspond to the decoder 118 of FIG. 1 or FIG. 3. For example, the method 700 may be performed by the second device 106 of FIG. 1.

The method 700 includes receiving an audio signal encoded based on sampling windows having a first window characteristic, at 702. For example, the audio signal may correspond to the encoded audio signal of FIG. 1 that includes the stereo cues 162, the side bitstream 164, and the mid bitstream 166. The audio signal may have been encoded by the encoder 114 of the first device 104 using sampling windows based on the first window parameters 152. For example, the first window parameters 152 may specify the first window characteristic that includes a window hop length, a window size overlap, a zero padding amount, or a center location. Other non-limiting examples include window shape, a flat window portion, or a window size.

The method 700 also includes decoding the audio signal using sampling windows having a second window characteristic different from the first window characteristic, at 704. For example, the audio signal may be decoded by the decoder 118 of the second device 106 using sampling windows based on the second window parameters 176. Decoding using the sampling windows having the second window characteristic may produce an inter-frame decoding delay that is less than a window overlap corresponding to the first window characteristic.

In some implementations, decoding the audio signal includes applying the sampling windows having the second window characteristic to generate a windowed time-domain audio decoding signal. For example, the sampling windows having the second window characteristic may be applied by the sample generator 172 of FIG. 1. As another example, the sampling windows having the second window characteristic may be applied at the transforms 308, 309 of FIG. 3. Decoding the audio signal may also include performing a transform operation on the windowed time-domain audio decoding signal to generate a windowed frequency-domain audio decoding signal. For example, the transform operation may be performed by the transform device 174 of FIG. 1. To illustrate, the transform operation may be performed by the transforms 308, 309 of FIG. 3.

The decoder 118 may receive first estimated stereo parameters corresponding to a windowed frequency-domain audio encoding signal based on the sampling windows having the first window characteristic. For example, the first estimated stereo parameters may correspond to or be included in the stereo cues 162 of FIGS. 1-3. Decoding the audio signal may include applying second estimated stereo parameters associated with the windowed frequency-domain audio decoding signal based on the sampling windows having the second window characteristic. For example, the second estimated stereo parameters may be generated to correspond to the sampling windows having the second window characteristic based on interpolation of the received first estimated stereo parameters.

The method 700 may thus enable the decoder reduce a decoding delay by using sampling windows having a reduced overlapping portion during decoding of an encoded audio signal, as compared to the overlapping portion of the sampling windows used to encode the encoded audio signal. Parameters (e.g., stereo cues 162) that may be generated during encoding using the sampling windows having the first characteristic (e.g., larger overlapping portion) may be interpolated during decoding to at least partially compensate for window differences in the sampling windows having the second characteristic. As a result, decoding delay may be improved with negligible impact on reproduced signal quality.

Referring to FIG. 8, a flow chart of a particular illustrative example of a method of operating a decoder is disclosed and generally designated 800. The decoder may correspond to the decoder 118 of FIG. 1 or FIG. 3. For example, the method 800 may be performed by the second device 106 of FIG. 1 or at another device, such as a base station.

The method 800 includes receiving stereo parameters encoded, by an encoder, based on a plurality of windows having a first length of overlapping portions between the plurality of windows, at 802. For example, the stereo parameters may include or correspond to the stereo cues 162. The stereo parameters may be included in an audio signal, such as the encoded audio signal of FIG. 1 that includes the stereo cues 162, the side bitstream 164, and the mid bitstream 166. The stereo parameters may have been encoded by the encoder 114 of the first device 104 using sampling windows based on the first window parameters 152. For example, the first window parameters 152 may specify the first window characteristics such as a window hop length, a window size overlap, a zero padding amount, or a center location. Other non-limiting examples of window characteristics include window shape, a flat window portion, or a window size.

The method 800 also includes generating, based on an upmix operation using the stereo parameters, at least two audio signals, at 804. The at least two audio signals are generated based on a second plurality of windows used in the upmix operation. The second plurality of windows has a second length of overlapping portions between the second plurality of windows. The second length is different from the first length. For example, the at least two audio signals may be generated by the decoder 118 of the second device 106 using sampling windows based on the second window parameters 176.

In some implementations, the plurality of windows is associated with a first hop length, and the second plurality of windows is associated with a second hop length. The first hop length and the second hop length may be the same hop length or may be different hop lengths. Additionally or alternatively, the plurality of windows may include a different number of windows as the second plurality of windows. In other implementations, the plurality of windows includes the same number of windows than the second plurality of windows. Additionally or alternatively, a first window of the plurality of windows and a second window of the second plurality of windows are the same size. In other implementations, the first window of the plurality of windows and the second window of the second plurality of windows are different sizes. Additionally or alternatively, each window of the plurality of windows are symmetric while a first particular window of the second plurality of windows is asymmetric. In other implementations, all of the plurality of windows are asymmetric.

In some implementations, the method 800 may include receiving an audio signal that includes the stereo parameters and applying the second plurality of windows to generate a windowed time-domain audio decoding signal. The method 800 may also include performing a transform operation on the windowed time-domain audio decoding signal to generate a windowed frequency-domain audio decoding signal.

In some implementations, a total length of each window the plurality of windows used during stereo downmix processing at the encoder is different from the total length of each window of the second plurality of windows used during stereo upmix processing at the decoder. The plurality of windows may correspond to DFT analysis windows used in the stereo downmix processing and the second plurality of windows may correspond to inverse DFT synthesis windows used in the stereo upmix processing. Additionally or alternatively, a first frequency resolution associated with each frequency bin in a transform domain at the encoder is different from a second frequency resolution associated with each frequency bin in the transform domain at the decoder.

In other implementations, a window location of each window of the plurality of windows used at the encoder is different from a window location of each window of the plurality of windows used at the decoder. Additionally or alternatively, at least one parameter of the stereo parameters is interpolated inter-frame, and wherein the at least one interpolated parameter are used at the decoder. This interpolation could be either performed at the encoder and transmitted to the decoder, or the encoder may transmit the un-interpolated values and the decoder may perform the inter-frame interpolation.

The method 800 may thus enable the decoder reduce a decoding delay by using sampling windows having a different length overlapping portion during decoding, as compared to a length of an overlapping portion of the sampling windows used to encode the encoded audio signal. As a result, decoding delay is significantly reduced with negligible impact on reproduced signal quality.

In particular aspects, the method 700 of FIG. 7 or the method 800 of FIG. 8 may be implemented by a field-programmable gate array (FPGA) device, an application-specific integrated circuit (ASIC), a processing unit such as a central processing unit (CPU), a digital signal processor (DSP), a controller, another hardware device, firmware device, or any combination thereof. As an example, the method 700 of FIG. 7 or the method 800 of FIG. 8 may be performed by a processor that executes instructions, as described with respect to FIG. 9.

Referring to FIG. 9, a block diagram of a particular illustrative example of a device (e.g., a wireless communication device) is depicted and generally designated 900. In various implementations, the device 900 may have more or fewer components than illustrated in FIG. 9. In an illustrative example, the device 900 may correspond to the system of FIG. 1. For example, the device 900 may correspond to the first device 104 or the second device 106 of FIG. 1. In an illustrative example, the device 900 may operate according to the method of FIG. 7 or the method of FIG. 8.

In a particular implementation, the device 900 includes a processor 906 (e.g., a CPU). The device 900 may include one or more additional processors, such as a processor 910 (e.g., a DSP). The processor 910 may include a CODEC 908, such as a speech CODEC, a music CODEC, or a combination thereof. The processor 910 may include one or more components (e.g., circuitry) configured to perform operations of the speech/music CODEC 908. As another example, the processor 910 may be configured to execute one or more computer-readable instructions to perform the operations of the speech/music CODEC 908. Thus, the CODEC 908 may include hardware and software. Although the speech/music CODEC 908 is illustrated as a component of the processor 910, in other examples one or more components of the speech/music CODEC 908 may be included in the processor 906, a CODEC 934, another processing component, or a combination thereof.

The speech/music CODEC 908 may include a decoder 992, such as a vocoder decoder. For example, the decoder 992 may correspond to the decoder 118 of FIG. 1. In a particular aspect, the decoder 992 is configured to decode an encoded signal using sampling windows having a second window characteristic that is different from a first window characteristic of sampling windows used to encode the signal. For example, the decoder 992 may be configured to use sampling windows based on one or more stored window parameters 991 (e.g., the second window parameters 176 of FIG. 1). The speech/music CODEC 908 may include an encoder 991, such as the encoder 114 of FIG. 1. The encoder 991 may be configured to encode audio signals using sampling windows having the first window characteristic.

The device 900 may include a memory 932 and the CODEC 934. The CODEC 934 may include a digital-to-analog converter (DAC) 902 and an analog-to-digital converter (ADC) 904. A speaker 936, a microphone array 938, or both may be coupled to the CODEC 934. The CODEC 934 may receive analog signals from the microphone array 938, convert the analog signals to digital signals using the analog-to-digital converter 904, and provide the digital signals to the speech/music CODEC 908. The speech/music CODEC 908 may process the digital signals. In some implementations, the speech/music CODEC 908 may provide digital signals to the CODEC 934. The CODEC 934 may convert the digital signals to analog signals using the digital-to-analog converter 902 and may provide the analog signals to the speaker 936.

The device 900 may include a wireless controller 940 coupled, via a transceiver 950 (e.g., a transmitter, a receiver, or both), to an antenna 942. The device 900 may include the memory 932, such as a computer-readable storage device. The memory 932 may include instructions 960, such as one or more instructions that are executable by the processor 906, the processor 910, or a combination thereof, to perform one or more of the techniques described with respect to FIGS. 1-6, the method of FIG. 7, the method of FIG. 8, or a combination thereof.

As an illustrative example, the memory 932 may store instructions that, when executed by the processor 906, the processor 910, or a combination thereof, cause the processor 906, the processor 910, or a combination thereof, to perform operations including receiving an audio signal encoded based on sampling windows having a first window characteristic (e.g., receiving the stereo cues 162 based on encoding sampling windows using the first window parameters 152) and decoding the audio signal using sampling windows having a second window characteristic different from the first window characteristic (e.g., based on the second window parameters 176).

As another illustrative example, the memory 932 may store instructions that, when executed by the processor 906, the processor 910, or a combination thereof, cause the processor 906, the processor 910, or a combination thereof, to perform operations including receiving stereo parameters (e.g., receiving the stereo cues 162) encoded, by an encoder, based on a plurality of windows having a first length of overlapping portions between the plurality of windows and generating, based on an upmix operation using the stereo parameters, at least two audio signals. The at least two audio signals are generated based on a second plurality of windows used in the upmix operation, the second plurality of windows having a second length of overlapping portions between the second plurality of windows. The second length is different from the first length.

In some implementations, the memory 932 may include code (e.g., interpreted or complied program instructions) that may be executed by the processor 906, the processor 910, or a combination thereof, to cause the processor 906, the processor 910, or a combination thereof, to perform functions as described with reference to the second device 106 of FIG. 1 or the decoder 118 of FIG. 1 or FIG. 3, to perform at least a portion of the method 700 of FIG. 7, to perform at least a portion of the method 800 of FIG. 8, or a combination thereof.

The memory 932 may include instructions 960 executable by the processor 906, the processor 910, the CODEC 934, another processing unit of the device 900, or a combination thereof, to perform methods and processes disclosed herein. One or more components of the system 100 of FIG. 1 may be implemented via dedicated hardware (e.g., circuitry), by a processor executing instructions (e.g., the instructions 960) to perform one or more tasks, or a combination thereof. As an example, the memory 932 or one or more components of the processor 906, the processor 910, the CODEC 934, or a combination thereof, may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 960) that, when executed by a computer (e.g., a processor in the CODEC 934, the processor 906, the processor 910, or a combination thereof), may cause the computer to perform at least a portion of the method of FIG. 7, at least a portion of the method of FIG. 8, or a combination thereof. As an example, the memory 932 or the one or more components of the processor 906, the processor 910, the CODEC 934 may be a non-transitory computer-readable medium that includes instructions (e.g., the instructions 960) that, when executed by a computer (e.g., a processor in the CODEC 934, the processor 906, the processor 910, or a combination thereof), cause the computer perform at least a portion of the method of FIG. 7, at least a portion of the method of FIG. 8, or a combination thereof.

In a particular implementation, the device 900 may be included in a system-in-package or system-on-chip device 922. In some implementations, the memory 932, the processor 906, the processor 910, the display controller 926, the CODEC 934, the wireless controller 940, and the transceiver 950 are included in a system-in-package or system-on-chip device 922. In some implementations, an input device 930 and a power supply 944 are coupled to the system-on-chip device 922. Moreover, in a particular implementation, as illustrated in FIG. 9, the display 928, the input device 930, the speaker 936, the microphone array 938, the antenna 942, and the power supply 944 are external to the system-on-chip device 922. In other implementations, each of the display 928, the input device 930, the speaker 936, the microphone array 938, the antenna 942, and the power supply 944 may be coupled to a component of the system-on-chip device 922, such as an interface or a controller of the system-on-chip device 922. In an illustrative example, the device 900 corresponds to a communication device, a mobile communication device, a smartphone, a cellular phone, a laptop computer, a computer, a tablet computer, a personal digital assistant, a set top box, a display device, a television, a gaming console, a music player, a radio, a digital video player, a digital video disc (DVD) player, an optical disc player, a tuner, a camera, a navigation device, a decoder system, an encoder system, a base station, a vehicle, or any combination thereof.

In conjunction with the described aspects, an apparatus may include means for receiving an audio signal encoded based on sampling windows having a first window characteristic. For example, the means for receiving may include or correspond to the receiver 178 of FIG. 1, the transceiver 950 of FIG. 9, one or more other structures, devices, circuits, modules, or instructions to receive an encoded audio signal, or a combination thereof.

The apparatus may also include means for decoding the audio signal using sampling windows having a second window characteristic different from the first window characteristic. For example, the means for decoding may include or correspond to the decoder 118 of FIG. 1 or FIG. 3, one or more of the processors 906, 910 programmed to execute the instructions 960 of FIG. 9, one or more other structures, devices, circuits, modules, or instructions to decode the audio signal, or a combination thereof.

The apparatus may include means for applying the sampling windows having the second window characteristic to generate a windowed time-domain audio decoding signal. For example, the means for applying may include or correspond to the sample generator 172 of FIG. 1, the decoder 902, one or more of the processors 906, 910 programmed to execute the instructions 960 of FIG. 9, one or more other structures, devices, circuits, modules, or instructions to apply the sampling windows, or a combination thereof.

The apparatus may also include means for performing a transform operation on the windowed time-domain audio decoding signal to generate a windowed frequency-domain audio decoding signal. For example, the means for performing a transform operation may include or correspond to the transform device 174 of FIG. 1, the transforms 308, 309 of FIG. 3, the decoder 992, one or more of the processors 906, 910 programmed to execute the instructions 960 of FIG. 9, one or more other structures, devices, circuits, modules, or instructions to perform the transform operation, or a combination thereof.

In another implementation, an apparatus includes means for receiving stereo parameters encoded, by an encoder, based on a plurality of windows having a first length of overlapping portions between the plurality of windows. For example, the means for receiving may include or correspond to the decoder 118, the receiver 178 of FIG. 1, the demultiplexer 302, the side signal decoder 306, the stereo cue processor 312 of FIG. 3, an upmixer, the transceiver 950 of FIG. 9, one or more other structures, devices, circuits, modules, or instructions to receive the stereo parameters, or a combination thereof. In some implementations, the stereo parameters may correspond to discrete Fourier transform (DFT) stereo cue parameters. The apparatus also includes means for performing an upmix operation using the stereo parameters to generate at least two audio signals. For example, the means for performing the upmix operation may include or correspond to the decoder 118 of FIG. 1, the upmixer 310, the stereo cue processor 312 of FIG. 3, one or more of the processors 906, 910 programmed to execute the instructions 960, the decoder 992 of FIG. 9, one or more other structures, devices, circuits, modules, or instructions to perform the upmix operation, or a combination thereof. The at least two audio signals are generated based on a second plurality of windows used in the upmix operation, the second plurality of windows having a second length of overlapping portions between the second plurality of windows. The second length is different from the first length. For example, the second length may be less than the first length.

In the aspects of the description described above, various functions performed have been described as being performed by certain components or modules, such as components or module of the system 100 of FIG. 1. However, this division of components and modules is for illustration only. In alternative examples, a function performed by a particular component or module may instead be divided amongst multiple components or modules. Moreover, in other alternative examples, two or more components or modules of FIG. 1 may be integrated into a single component or module. Each component or module illustrated in FIG. 1 may be implemented using hardware (e.g., an ASIC, a DSP, a controller, a FPGA device, etc.), software (e.g., instructions executable by a processor), or any combination thereof.

Those of skill would further appreciate that the various illustrative logical blocks, configurations, modules, circuits, and algorithm steps described in connection with the aspects disclosed herein may be implemented as electronic hardware, computer software executed by a processor, or combinations of both. Various illustrative components, blocks, configurations, modules, circuits, and steps have been described above generally in terms of their functionality. Whether such functionality is implemented as hardware or processor executable instructions depends upon the particular application and design constraints imposed on the overall system. Skilled artisans may implement the described functionality in varying ways for each particular application, such implementation decisions are not to be interpreted as causing a departure from the scope of the present disclosure.

The steps of a method or algorithm described in connection with the aspects disclosed herein may be included directly in hardware, in a software module executed by a processor, or in a combination of the two. A software module may reside in RAM, flash memory, ROM, PROM, EPROM, EEPROM, registers, hard disk, a removable disk, a CD-ROM, or any other form of non-transient storage medium known in the art. A particular storage medium may be coupled to the processor such that the processor may read information from, and write information to, the storage medium. In the alternative, the storage medium may be integral to the processor. The processor and the storage medium may reside in an ASIC. The ASIC may reside in a computing device or a user terminal. In the alternative, the processor and the storage medium may reside as discrete components in a computing device or user terminal.

The previous description is provided to enable a person skilled in the art to make or use the disclosed aspects. Various modifications to these aspects will be readily apparent to those skilled in the art, and the principles defined herein may be applied to other aspects without departing from the scope of the disclosure. Thus, the present disclosure is not intended to be limited to the aspects shown herein and is to be accorded the widest scope possible consistent with the principles and novel features as defined by the following claims.

What is claimed is:

1. A device comprising:

a receiver configured to receive stereo parameters encoded, by an encoder, based on a plurality of windows having a first length of overlapping portions between the plurality of windows; and a decoder configured to perform an upmix operation using the stereo parameters to generate at least two audio signals, the at least two audio signals generated based on a second plurality of windows used in the upmix operation, the second plurality of windows having a second length of overlapping portions between the second plurality of windows, the second length different from the first length.

2. The device of claim 1, wherein a total length of each window the plurality of windows used during stereo downmix processing at the encoder is different from the total length of each window of the second plurality of windows used during stereo upmix processing at the decoder.

3. The device of claim 2, wherein the plurality of windows corresponds to DFT analysis windows used in the stereo downmix processing and the second plurality of windows correspond to inverse DFT synthesis windows used in the stereo upmix processing.

4. The device of claim 2, wherein a first frequency resolution associated with each frequency bin in a transform domain at the encoder is different from a second frequency resolution associated with each frequency bin in the transform domain at the decoder.

5. The device of claim 1, wherein a window location of each window of the plurality of windows used at the encoder is different from a window location of each window of the plurality of windows used at the decoder.

6. The device of claim 5, wherein at least one parameter of the stereo parameters is interpolated inter-frame, and wherein the at least one interpolated parameter and at least one un-interpolated values are used at the decoder.

7. The device of claim 1, wherein a window overlap of the second plurality of windows is asymmetric.

8. The device of claim 1, wherein the receiver is further configured to receive a mid signal.

9. The device of claim 8, wherein the mid signal is generated, by the encoder, based on a downmix operation using the stereo parameters.

10. The device of claim 8, wherein the upmix operation is performed using the stereo parameters and the mid signal.

11. The device of claim 1, wherein both windows of a pair of consecutive windows of the second plurality of windows are asymmetric.

12. The device of claim 1, wherein a first window of a pair of consecutive windows of the second plurality of windows is asymmetric.

13. The device of claim 12, wherein a third length of a first overlap portion of the first window and the second window is different from a fourth length of a second overlap portion of the second window and a third window of a second pair of consecutive windows.

14. The device of claim 1, wherein the receiver is configured to receive an audio signal that includes the stereo parameters, and wherein the decoder is configured to apply the second plurality of windows during decoding of the audio signal to generate a windowed time-domain audio decoding signal.

15. The device of claim 1, wherein the receiver and the decoder are integrated into a mobile communication device.

16. The device of claim 1, wherein the receiver and the decoder are integrated into a base station.

17. A method comprising:

receiving stereo parameters encoded, by an encoder, based on a plurality of windows having a first length of overlapping portions between the plurality of windows; and generating, based on an upmix operation using the stereo parameters, at least two audio signals, the at least two audio signals generated based on a second plurality of windows used in the upmix operation, the second plurality of windows having a second length of overlapping portions between the second plurality of windows, the second length different from the first length.

18. The method of claim 17, wherein the plurality of windows is associated with a first hop length and the second plurality of windows is associated with a second hop length.

19. The method of claim 17, wherein the plurality of windows includes a different number of windows than the second plurality of windows.

20. The method of claim 17, wherein a first window of the plurality of windows and a second window of the second plurality of windows are the same size.

21. The method of claim 17, wherein each window of the plurality of windows are symmetric, and wherein a first window of the second plurality of windows is asymmetric.

22. The method of claim 17, further comprising:

receiving an audio signal that includes the stereo parameters; and applying the second plurality of windows to generate a windowed time-domain audio decoding signal.

23. The method of claim 22, further comprising performing a transform operation on the windowed time-domain audio decoding signal to generate a windowed frequency-domain audio decoding signal.

24. The method of claim 17, wherein receiving and generating are performed at a device that comprises a mobile communication device.

25. The method of claim 17, wherein receiving and generating are performed at a device that comprises a base station.

26. An apparatus comprising:

means for receiving stereo parameters encoded, by an encoder, based on a plurality of windows having a first length of overlapping portions between the plurality of windows; and means for performing an upmix operation using the stereo parameters to generate at least two audio signals, the at least two audio signals generated based on a second plurality of windows used in the upmix operation, the second plurality of windows having a second length of overlapping portions between the second plurality of windows, the second length different from the first length.

27. The apparatus of claim 26, further comprising:

means for applying the second plurality of windows to generate a windowed time-domain audio decoding signal; and means for performing a transform operation on the windowed time-domain audio decoding signal to generate a windowed frequency-domain audio decoding signal.

28. The apparatus of claim 26, wherein the means for receiving and the means for performing are integrated into a mobile communication device.

29. The apparatus of claim 26, wherein the means for receiving and the means for performing are integrated into a base station.

30. A computer-readable storage device storing instructions that, when executed by a processor, cause the processor to perform operations comprising:

receiving stereo parameters encoded, by an encoder, based on a plurality of windows having a first length of overlapping portions between the plurality of windows; and generating, based on an upmix operation using the stereo parameters, at least two audio signals, the at least two audio signals generated based on a second plurality of windows used in the upmix operation, the second plurality of windows having a second length of overlapping portions between the second plurality of windows, the second length different from the first length.

31. The computer-readable storage device of claim 30, wherein the second length is less than the first length.

32. The computer-readable storage device of claim 30, wherein the stereo parameters correspond to discrete Fourier transform (DFT) stereo cue parameters.

* * * * *